US011510464B2

(12) United States Patent
Kim

(10) Patent No.: US 11,510,464 B2
(45) Date of Patent: Nov. 29, 2022

(54) SEALING ZIPPER AND SEALING ZIPPER ASSEMBLY

(71) Applicant: Young Gyo Kim, Busan (KR)

(72) Inventor: Young Gyo Kim, Busan (KR)

( * ) Notice: Subject to any disclaimer, the term of this patent is extended or adjusted under 35 U.S.C. 154(b) by 0 days.

(21) Appl. No.: 17/420,510

(22) PCT Filed: Nov. 28, 2019

(86) PCT No.: PCT/KR2019/016606
§ 371 (c)(1),
(2) Date: Jul. 2, 2021

(87) PCT Pub. No.: WO2020/141732
PCT Pub. Date: Jul. 9, 2020

(65) Prior Publication Data

US 2022/0079302 A1 Mar. 17, 2022

(30) Foreign Application Priority Data

Jan. 2, 2019 (KR) ..... 10-2019-0000437
Sep. 17, 2019 (KR) ..... 10-2019-0114046

(51) Int. Cl.
*A44B 19/32* (2006.01)
*A44B 19/02* (2006.01)
*B65D 33/25* (2006.01)

(52) U.S. Cl.
CPC ..... *A44B 19/32* (2013.01); *A44B 19/02* (2013.01); *B65D 33/2508* (2013.01)

(58) Field of Classification Search
CPC ..... A44B 19/32; A44B 19/02; A44B 18/00; B65D 33/2508; B65D 33/2584; B65B 61/18
See application file for complete search history.

(56) References Cited

U.S. PATENT DOCUMENTS 2,641,037 A * 6/1953 Gossner ..... A44B 19/32 24/384
2,651,091 A * 9/1953 Priestley ..... A44B 19/32 24/384
2,841,851 A * 7/1958 Van Amburg ..... A44B 19/32 24/384
3,005,247 A * 10/1961 Doelter ..... A44B 19/32 24/389

(Continued)

FOREIGN PATENT DOCUMENTS

KR 10-2006-0110889 A 10/2006
KR 10-1880278 B1 8/2018

OTHER PUBLICATIONS

International Search Report for PCT/KR2019/016606 dated Mar. 4, 2020.

*Primary Examiner* — Robert Sandy
*Assistant Examiner* — Louis A Mercado
(74) *Attorney, Agent, or Firm* — The PL Law Group, PLLC

(57) ABSTRACT

A sealing zipper according to an embodiment includes a first chain portion, a second chain portion, a chain fixing portion, and a watertight portion. The second chain portion is coupled to the first chain portion. The chain fixing portion is coupled to one end portion of the first chain portion and one end portion of the second chain portion. The watertight portion is positioned between the first chain portion and the second chain portion and disposed to be partially inserted into the chain fixing portion.

10 Claims, 10 Drawing Sheets

(56) References Cited

U.S. PATENT DOCUMENTS

| | | | | | |
|---|---|---|---|---|---|
| 4,780,937 | A * | 11/1988 | Kusayama | A44B 19/32 | 24/389 |
| 4,782,563 | A * | 11/1988 | Kusayama | A44B 19/36 | 24/389 |
| 4,817,252 | A * | 4/1989 | Kusayama | A44B 19/32 | 24/384 |
| 6,035,496 | A * | 3/2000 | Germani | A44B 19/32 | 24/384 |
| 6,363,531 | B1 * | 4/2002 | Quinn | A44B 19/32 | 2/82 |
| 6,363,553 | B1 | 4/2002 | Falko et al. | | |
| 6,438,757 | B1 * | 8/2002 | Quinn | A41D 13/012 | 2/82 |
| 6,497,014 | B2 * | 12/2002 | Neugebauer | A44B 19/32 | 24/387 |
| 7,082,648 | B2 * | 8/2006 | Morioka | A44B 19/32 | 24/389 |
| 9,456,664 | B2 * | 10/2016 | Tanaka | A44B 19/60 | |
| 2006/0282995 | A1 | 12/2006 | Liou | | |

* cited by examiner (a)

(b)

SEALING ZIPPER AND SEALING ZIPPER ASSEMBLY

CROSS REFERENCE TO RELATED APPLICATIONS AND CLAIM OF PRIORITY

This application claims benefit under 35 U.S.C. 119(e), 120, 121, or 365(c), and is a National Stage entry from International Application No. PCT/KR2019/016606, filed Nov. 28, 2019, which claims the benefit of Korean Patent Applications No. 10-2019-0000437 filed on Jan. 2, 2019 and 10-2019-0114046 filed on Sep. 17, 2019 at the Korean Intellectual Property Office, the disclosures of which are incorporated by reference herein in their entirety.

BACKGROUND

1. Technical Field

The present disclosure relates to a sealing zipper mounted on a container and a sealing zipper assembly including a rider.

2. Background Art

In general, a sealing zipper is a zipper attached to a container (i.e., a structure able to maintain the accommodation state of contents) such that liquid contents, such as a seasoning, a detergent, or a shampoo, or gas content may be contained in the container while being maintained in an airtight state. In particular, when gas is to be received, it is important to maintain airtightness, and thus, it is relatively difficult to introduce or discharge gas into or from the container, which is problematic. When gas is to be withdrawn from the container, gas must be discharged in a reverse direction through a structure by which gas has been introduced. A structure mainly serving to maintain airtightness is configured so as to facilitate the introduction of gas. In contrast, according to the configuration of this structure, gas may be withdrawn by a somewhat cumbersome process. In a case in which a zipper is used in order to compensate for this, it may be difficult to maintain airtightness in the case of zipper fastening though gas may be withdrawn by a simple process. That is, the zipper is required to have coupling force able to withstand air pressure. Thus, the ease of discharging air after air has been blown into a container and the fastening force of the zipper for maintaining the airtight state when air is contained within the container are required.

In addition, when a zipper of a zipper bag is in an engaged position, contents, such as liquid or powder, may contact the zipper according to the state in which the zipper bag is placed. In this case, the zipper may be contaminated by the contents, and when the contents are caught between zipper components, the coupling force of the zipper may be reduced. Accordingly, the zipper needs to be protected from the contents, and at the same time, there is a demand for a zipper bag allowing the contents to be input thereinto without interruption and a protection device for the zipper.

SUMMARY

Accordingly, the present disclosure has been made in consideration of the above-described problems occurring in the related art, and an objective to be realized by an embodiment of the present disclosure is to realize stronger zipper fastening by the engagement between coupling teeth of a zipper.

Another objective to be realized by an embodiment of the present disclosure is to provide a sealed state by which water-tightness may be maintained after the fastening of the zipper.

Another objective to be realized by an embodiment of the present disclosure is to reliably maintain fastening force even in the case that the zipper is pulled in the transverse direction.

Another objective to be realized by an embodiment of the present disclosure is to prevent a sealing structure from being contaminated by contents (e.g., liquid or powder) contained in an accommodation space so that the sealing force of the sealing structure is not reduced.

According to an aspect of the present disclosure, provided is a sealing zipper including: a first chain; a second chain configured to be coupled to the first chain; a chain holder coupled to one end of the first chain and one end of the second chain; and a watertight part located between the first chain and second chain, with a portion of the watertight part being inserted into the chain holder.

In addition, the first chain may include a first upper chain including 1-1$^{st}$ coupling teeth and 1-2$^{nd}$ coupling teeth provided as double layers on one surface side of the watertight part and a first lower chain including 1-3$^{rd}$ coupling teeth and 1-4$^{th}$ coupling teeth provided as double layers on the other surface side of the watertight part. The second chain may include a second upper chain including 2-1$^{st}$ coupling teeth and 2-2$^{nd}$ coupling teeth provided as double layers on one surface side of the watertight part and a second lower chain including 2-3$^{rd}$ coupling teeth and 2-4$^{th}$ coupling teeth provided as double layers on the other surface side of the watertight part.

In addition, the sealing zipper may be fastened by coupling between the first upper chain and the second upper chain and coupling between the first lower chain and the second lower chain.

In addition, the thickness of each of the 1-4$^{th}$ coupling teeth and the 2-4$^{th}$ coupling teeth may be greater than the thickness of each of the 1-3$^{rd}$ coupling teeth and the 2-3$^{rd}$ coupling teeth.

In addition, the 1-1$^{st}$ coupling teeth and the 1-2$^{nd}$ coupling teeth provided as the double layers may be inversely symmetrical to each other, the 1-3$^{rd}$ coupling teeth and the 1-4$^{th}$ coupling teeth provided as the double layers may be inversely symmetrical to each other, the 2-1$^{st}$ coupling teeth and the 2-2$^{nd}$ coupling teeth provided as the double layers may be inversely symmetrical to each other, and the 2-3$^{rd}$ coupling teeth and the 2-4$^{th}$ coupling teeth provided as the double layers may be inversely symmetrical to each other.

In addition, the chain holder may include an elastic restoring portion including an insertion hole and an incision portion and an insertion recess into which one end of the watertight part is inserted. The watertight part may include a protrusion protruding from the one end. The watertight part and the chain holder may be coupled to each other, with the protrusion being inserted into the insertion hole.

In addition, each of the first guide and the second guide may include a guide groove provided in a longitudinal direction. The first chain and the second chain may be coupled to each other in response to a rider moving in a guiding direction of the guide grooves.

In addition, the watertight part may include a concavely-curved portion.

The sealing zipper may include: a first attachment portion connected to a bottom portion of the first chain; and a second attachment portion connected to a bottom portion of the second chain. A protection member may be disposed between the first attachment portion and the second attachment portion to protect the first chain and the second chain. One portion of the protection member may be attached to one of the first attachment portion and the second attachment portion.

The protection member may include: a first horizontal portion horizontally extending toward the first support portion; a second horizontal portion horizontally extending toward the second support portion; and a central portion located between the first support portion and the second support portion and including a space portion therein.

The space portion may be filled with air or a material lighter than water.

Provided is a sealing zipper assembly including: a first chain; a second chain configured to be coupled to the first chain; a chain holder coupled to one end of the first chain and one end of the second chain; a watertight part located between the first chain and the second chain and configured such that a portion thereof is inserted into the chain holder; and a rider configured to couple and decouple the first chain and the second chain while moving in a longitudinal direction along one surface of the first chain and one surface of the second chain.

According to an embodiment of the present disclosure, the upper and lower coupling teeth having the shape of double layers may be coupled to corresponding upper and lower coupling teeth having the shape of double layers, so that the zipper may be fastened more securely.

According to an embodiment of the present disclosure, the watertight part able to maintain watertightness after the fastening of the zipper may be disposed between the coupling teeth in order to maintain the sealed state.

According to an embodiment of the present disclosure, the thickness of the coupling teeth to which transverse pulling force is applied may be greater than the thickness of the other coupling teeth so as to reliably maintain the fastening force of the zipper.

According to an embodiment of the present disclosure, the protection member prevents contents accommodated in the accommodation space from arriving at the first chains and the second chains of the sealing zipper, thereby preventing the sealing zipper from being contaminated by the contents. The normal state of the sealing zipper may be maintained, and thus, the sealing force of the zipper may be maintained in an optimal state.

According to an embodiment of the present disclosure, the introduction of the contents into the accommodation space may not be obstructed while the sealing zipper is protected by the protection member.

Figure 3:
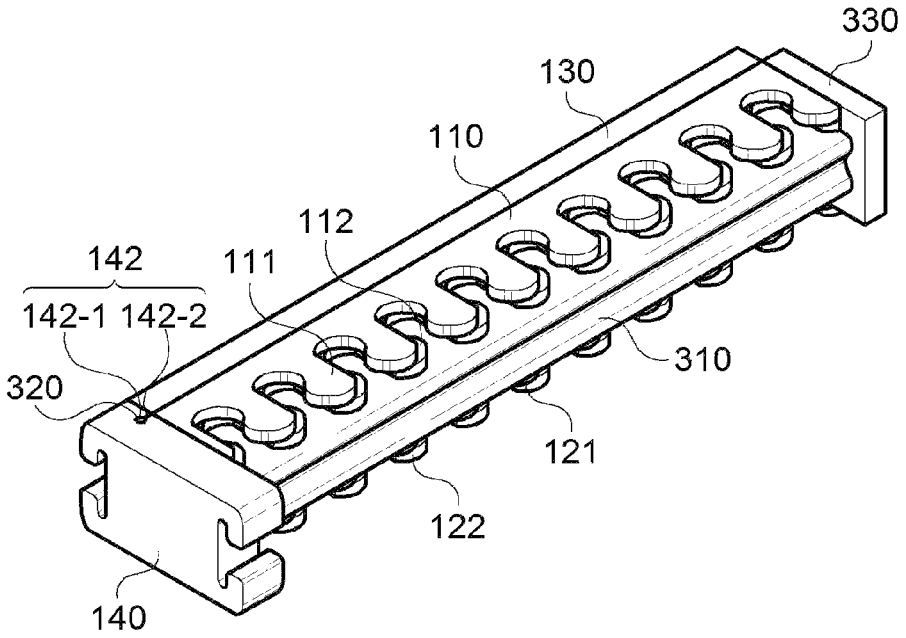
Figure 3:
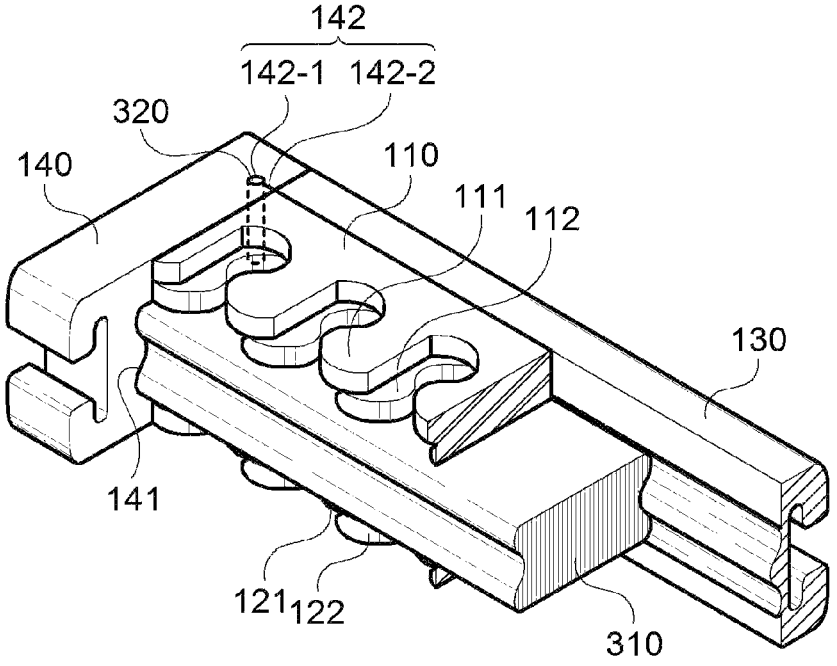
Figure 4:
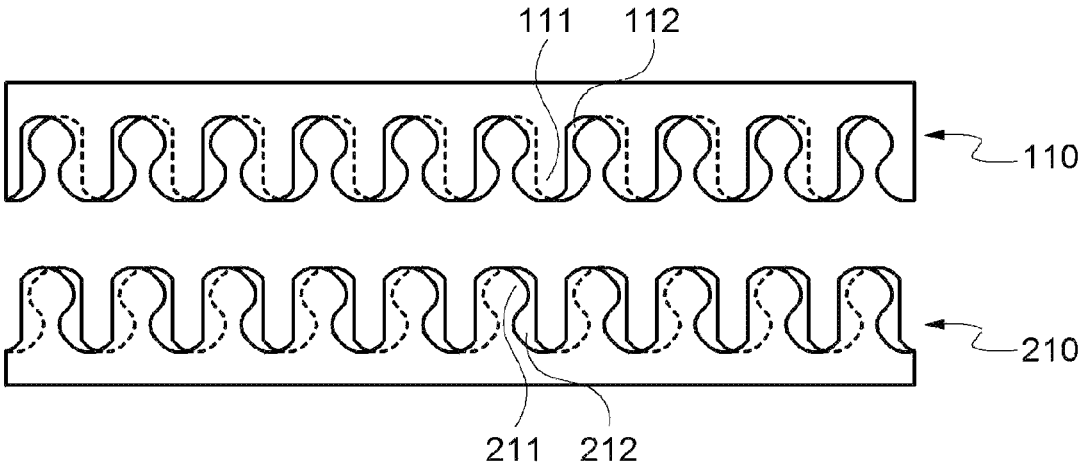
Figure 5:
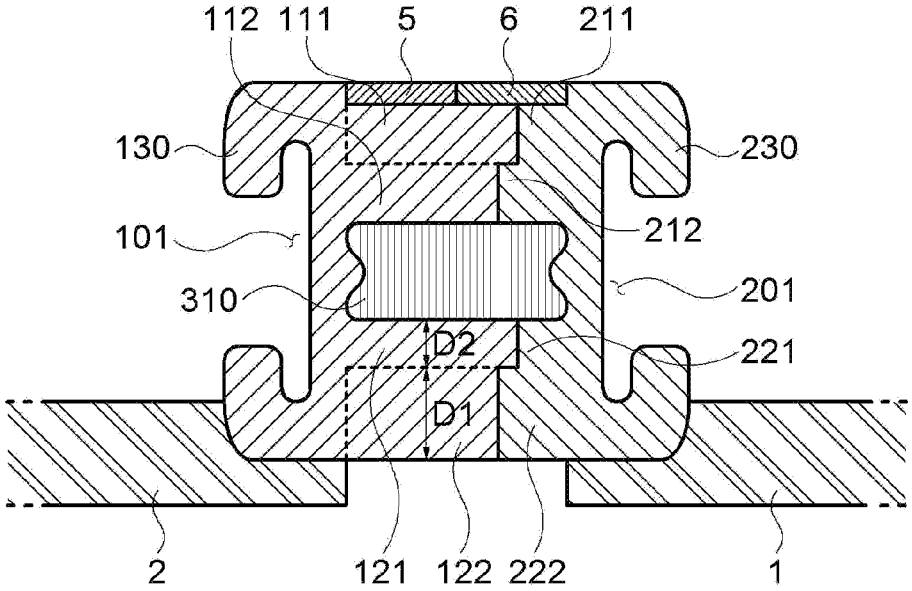
Figure 6:
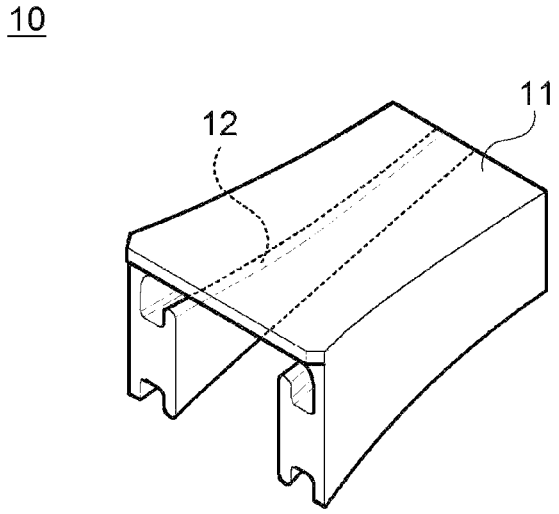
Figure 7:
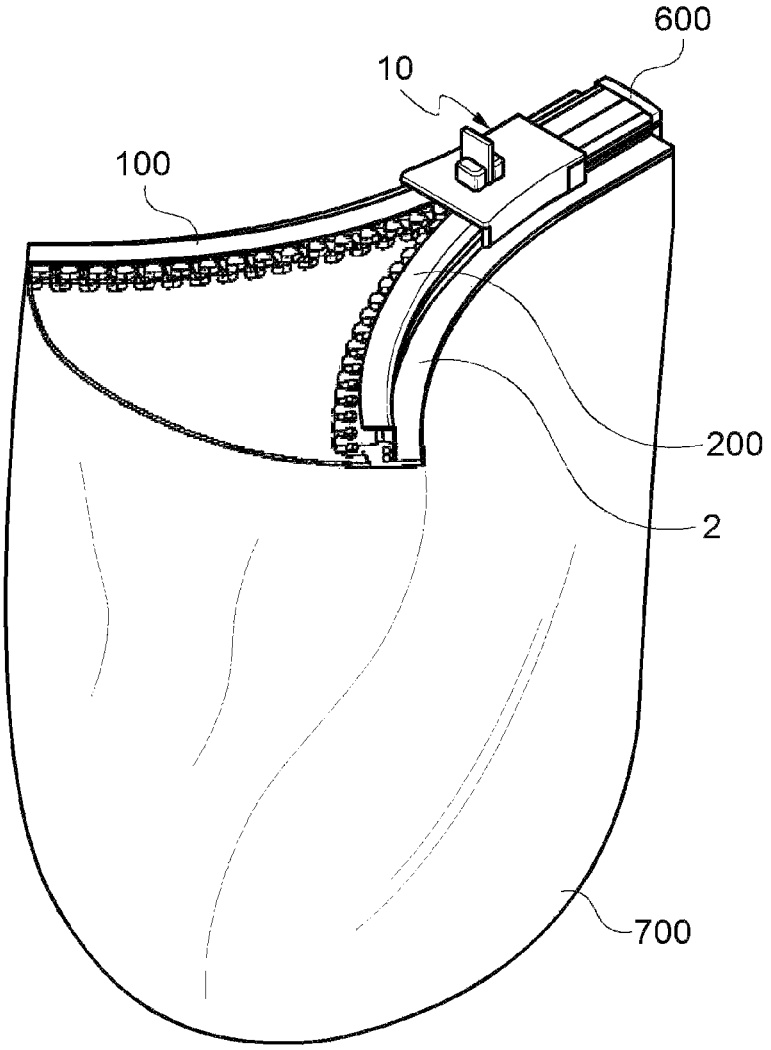
Figure 8:
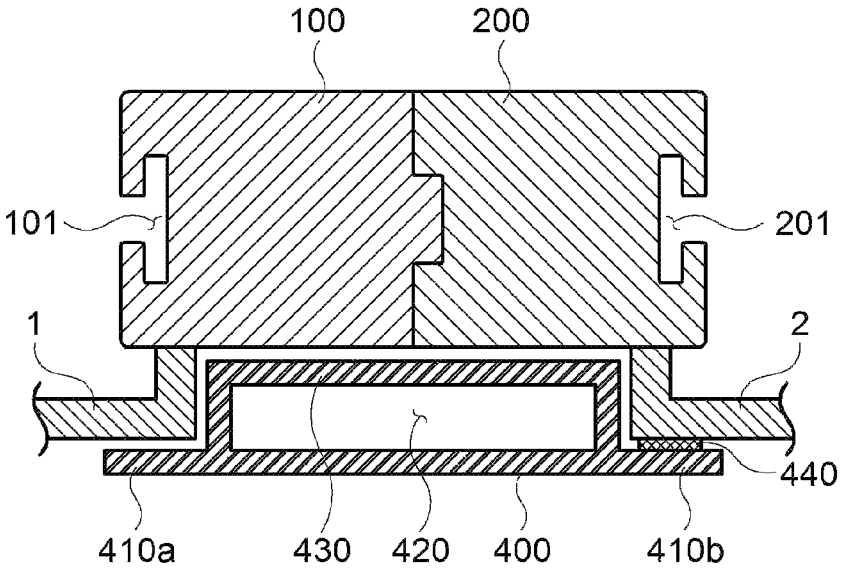
Figure 9:
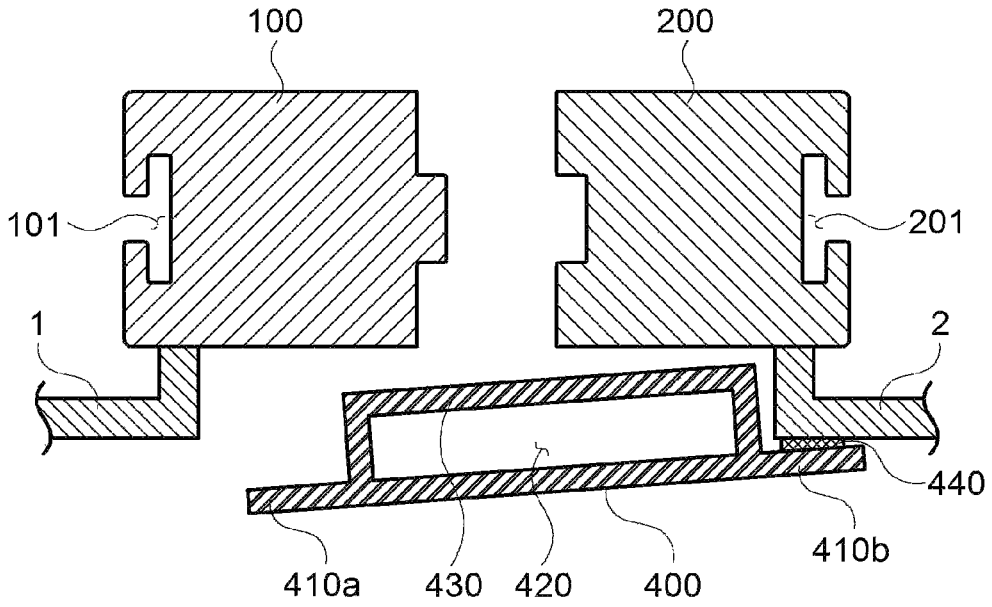
Figure 10:
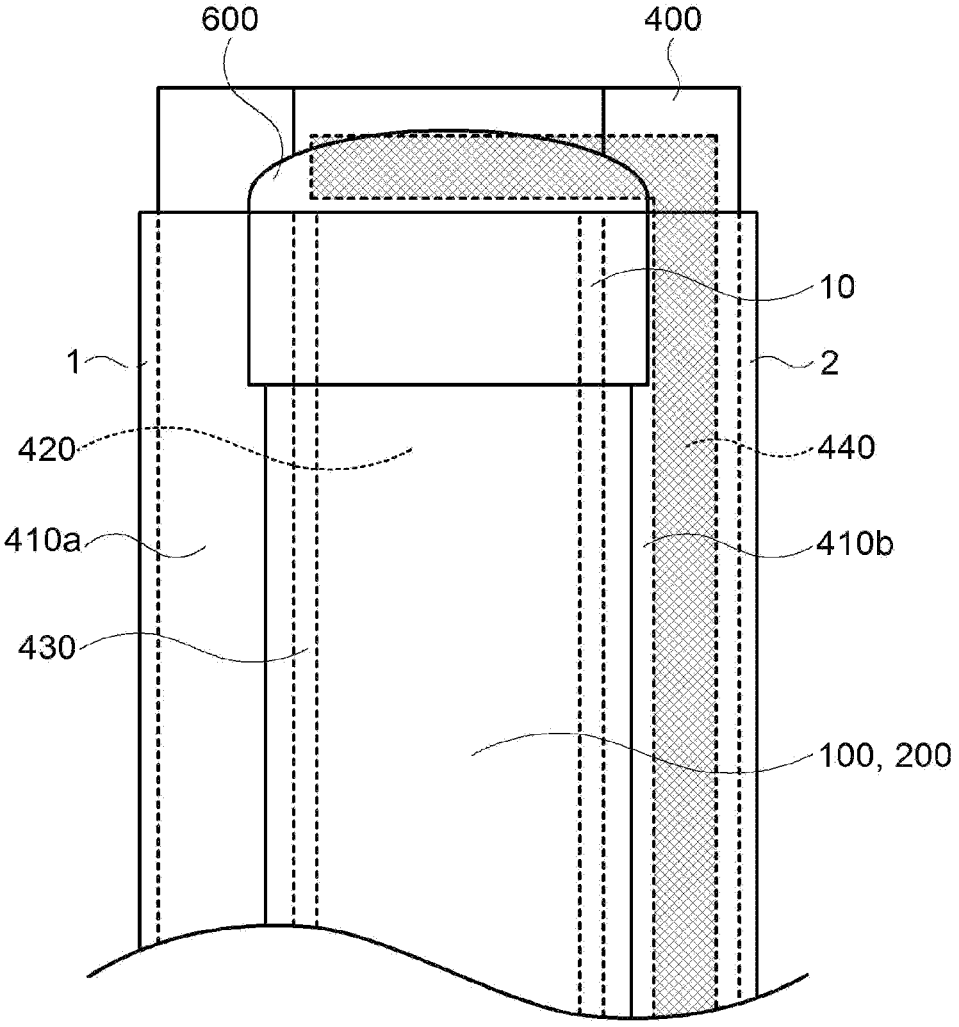

(a) of FIG. 3 is a perspective view illustrating the decoupled state of the coupling teeth of the sealing zipper according to an embodiment of the present disclosure, and (b) of FIG. 3 is a view illustrating the protrusion coupled to the chain holder of the sealing zipper according to an embodiment of the present disclosure;

FIG. 4 is a view illustrating the first upper chain and the second upper chain of the sealing zipper according to an embodiment of the present disclosure;

FIG. 5 is a cross-sectional view illustrating the sealing zipper according to an embodiment of the present disclosure;

FIG. 6 is a perspective view illustrating a rider according to an embodiment of the present disclosure;

FIG. 7 is a view illustrating an example sealing zipper according to another embodiment of the present disclosure;

FIG. 8 is a cross-sectional view illustrating a coupled state of the first chains and the second chains of the sealing zipper according to another embodiment of the present disclosure;

FIG. 9 is a cross-sectional view illustrating a decoupled state of the first chains and the second chains illustrated in FIG. 8; and FIG. 10 is a plan perspective view illustrating a sealing zipper according to an embodiment of the present disclosure.

DETAILED DESCRIPTION

Hereinafter, specific embodiments of the present disclosure will be described in detail with reference to the accompanying drawings. It should be understood, however, the description is provided for illustrative purposes only and not provided to limit the present disclosure.

In the following description of the present disclosure, detailed descriptions of known functions and configurations incorporated herein will be omitted in the case in which the subject matter of the present disclosure would be rendered unclear thereby. The terms used hereinafter are defined in consideration of functions used in the present disclosure, and may be changed according to the intent of users or operators or practices. Accordingly, the terms should be defined on the basis of the entire description of the present specification.

The technical principle of the present disclosure is defined by the Claims. The following embodiments are merely a means for effectively describing the technical principle of the present disclosure to a person having ordinary knowledge in the technical field to which the present disclosure pertains.

Figure 1:
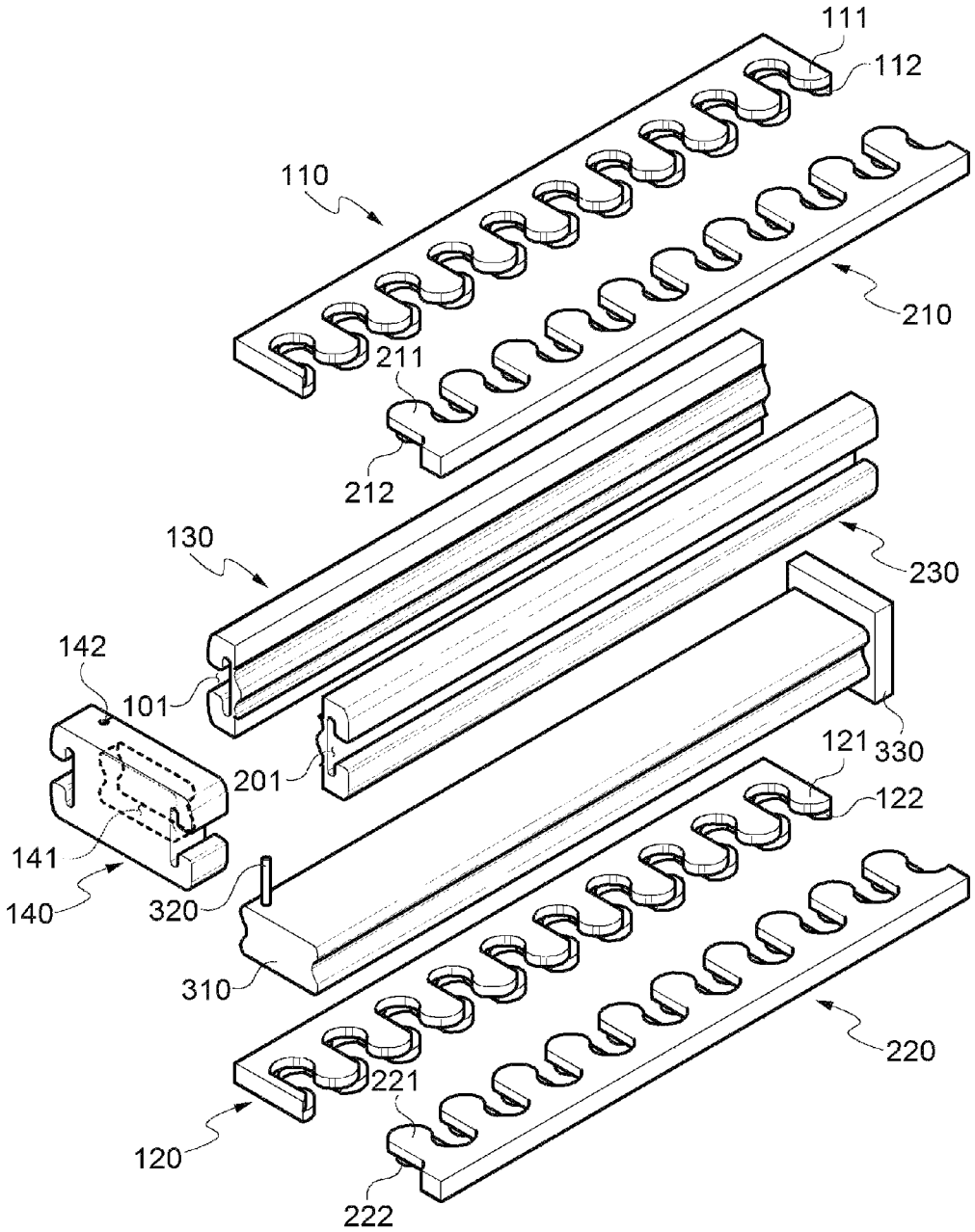
FIG. 1 is an exploded perspective view illustrating a sealing zipper according to an embodiment of the present disclosure.
Figure 2:
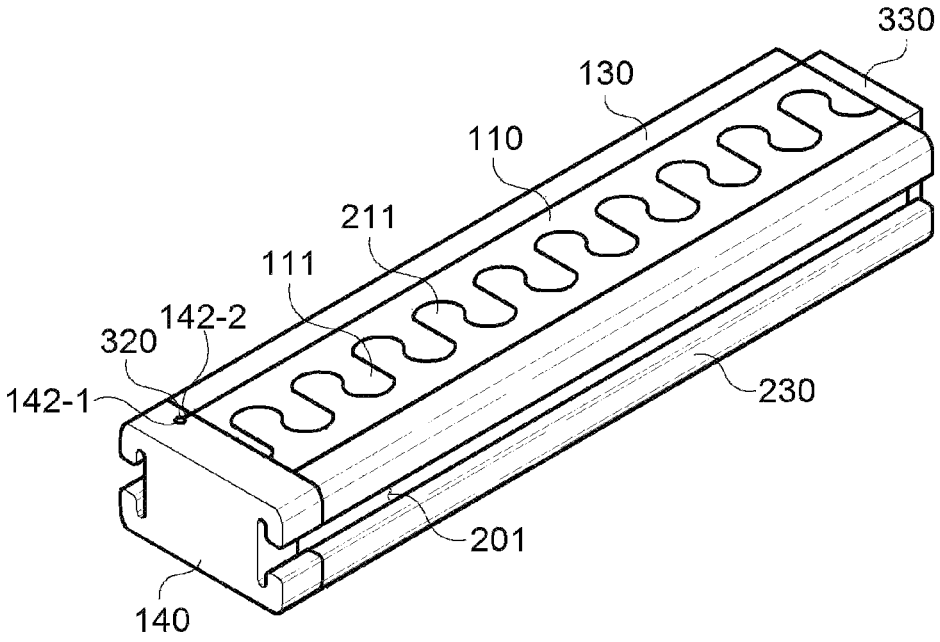
FIG. 2 is a perspective view illustrating the sealing zipper according to an embodiment of the present disclosure.

FIG. 1 is an exploded perspective view illustrating a sealing zipper according to an embodiment of the present disclosure, and FIG. 2 is a perspective view illustrating the sealing zipper according to an embodiment of the present disclosure.

Referring to FIGS. 1 and 2, the sealing zipper includes first chain 100, a first guide 130, second chains 200, a second guide, a watertight part (including a body portion 310, a head portion 330 and a protrusion 320), and a chain holder 140. Here, the first chains 100, the first guide 130, the chain holder 140, and the watertight part may be in a coupled state. In addition, the second chains 200 and the second guide may be in a coupled state. Further, the second chains 200 and the second guide may be in a coupled state. Here, one end of the second chains 200 and one end of the second guide may be coupled to the chain holder 140.

Specifically, the first chains 100 include a first upper chain 110 and a first lower chain 120. The second chains 200 include a second upper chain 210 and a second lower chain 220. The first upper chain 110 and the first lower chain 120 are respectively toothed in one direction. The second upper chain 210 and the second lower chain 220 are respectively toothed in a direction opposite the first upper chain 110 and the first lower chain 120. With this structure, the first upper chain 110 is coupled to the second upper chain 210, and the first lower chain 120 is coupled to the second lower chain 220.

The watertight part made from a soft material may be disposed between the first upper chain 110 and the second upper chain 210 and between the first lower chain 120 and the second lower chain 220. The watertight part may be an elastic material. For example, the watertight part may be a material such as rubber or silicone. Since the watertight part disposed between the first upper chain 110 and the second upper chain 210 and between the first lower chain 120 and the second lower chain 220, the watertight part may be under a predetermined pressure. Since the watertight part has elasticity, the watertight part may occupy a space that may be formed between the first upper chain 110 and the second upper chain 210 and a space that may be formed between the first lower chain 120 and the second lower chain 220 in order to provide watertightness using the pressure. Accordingly, the watertight part may cause the space between the first upper chain 110 and the second upper chain 210 to be airtight and the space between the first lower chain 120 and the second lower chain 220 to be airtight.

In addition, the first guide 130 and the second guide may be provided and arranged symmetrically to each other. Guide grooves 101 and 201 may be formed in the first guide 130 and the second guide in opposite directions. The guide grooves 101 and 201 may be formed in the longitudinal direction of the sealing zipper. A rider may couple or decouple the first chains 100 and the second chains 200 while being guided to move along the guide grooves 101 and 201.

In addition, the chain holder 140 may be coupled to the watertight part. The watertight part includes a body portion 310 extending in the longitudinal direction of the sealing zipper, a head portion 330 provided on one end of the body portion 310, and a protrusion 320 provided on the other side of the body portion 310. The chain holder 140 may be coupled to the other end on which the protrusion 320 is provided. The chain holder 140 includes an insertion recess 141 into which the other end of the body portion 310 may be inserted and an elastic restoring portion 142 that may elastically accommodate external force applied thereto. The elastic restoring portion 142 includes an incision portion 142-2 and an insertion hole 142-1. The chain holder 140 and the watertight part may be coupled to each other in a state in which the protrusion 320 of the watertight part is inserted into the insertion hole 142-1. The watertight part coupled to the chain holder 140 may be in a state in which the other end is inserted into the insertion recess 141.

In addition, the head portion 330 on one end of the watertight part may be exposed to the outside of the sealing zipper. The head portion 330 may be in contact with ends of the first chains 100, the second chains 200, the first guide 130, and the second guide to maintain the sealed state of the container to which the sealing zipper is attached. The sealed state means an airtight and watertight state that prevents a fluid, such as water or air, from passing between the first chains 100 and the second chains 200.

The first chains 100 and the second chains 200 may be configured such that teeth of the first chains 100 alternate with teeth of the second chains, and may be coupled to each other. In addition, each of the first upper chain 110, the first lower chain 120, the second upper chain 210, and the second lower chain 220 may have a double-layered tooth profile. Specifically, the tooth profile of the first upper chain 110 may be configured such that 1-1$^{st}$ coupling teeth 111 and 1-2$^{nd}$ coupling teeth 112 are fixedly provided in the shape of double layers, and the tooth profile of the first lower chain 120 may be configured such that 1-3$^{rd}$ coupling teeth 121 and 1-4$^{th}$ coupling teeth are fixedly provided in the shape of double layers. Further, the tooth profile of the second upper chain 210 may be configured such that 2-1$^{st}$ coupling teeth 211 and 2-2$^{nd}$ coupling teeth 212 are fixedly provided in the shape of double layers, and the tooth profile of the second lower chain 220 may be configured such that 2-3$^{rd}$ coupling teeth 221 and 2-4$^{th}$ coupling teeth 222 are fixedly provided in the shape of double layers.

The coupling teeth and the counterpart coupling teeth may have the same thickness such that the coupling teeth may be smoothly engaged with the counterpart coupling teeth. That is, the thickness of the 1-1$^{st}$ coupling teeth 111 may be the same as the thickness of the 2-1$^{st}$ coupling teeth 211, and the thickness of the 1-2$^{nd}$ coupling teeth 112 may be the same as the thickness of the 2-2$^{nd}$ coupling teeth 212. In addition, the thickness of the 1-3$^{rd}$ coupling teeth 121 may be the same as the thickness of the 2-3$^{rd}$ coupling teeth 221, and the thickness of the 1-4$^{th}$ coupling teeth 122 may be the same as the thickness of the 2-4$^{th}$ coupling teeth 222.

Furthermore, the first guide 130 and the second guide having the guide grooves 101 and 201 may be configured such that the rider may move along the guide grooves 101 and 201. The sealing zipper may have no travel limit points of the rider thereon, and the rider may completely move through and beyond the sealing zipper. Accordingly, a non-interference structure or a movement aid structure may be provided on each of both ends of the guide grooves 101 and 201, on an extension of the guide groove 101 or 201. For example, the movement aid structure may be disposed on each of both ends of the illustrated chain holder 140, as a structure connected to the guide groove 101 or 201. This movement aid structure may have the same shape as the guide groove 101 or 201. Thus, this structure may not cause interference during the passage of the rider.

(a) of FIG. 3 is a perspective view illustrating the decoupled state of the coupling teeth of the sealing zipper according to an embodiment of the present disclosure, and (b) of FIG. 3 is a view illustrating the protrusion 320 coupled to the chain holder 140 of the sealing zipper according to an embodiment of the present disclosure.

Referring to (a) of FIG. 3, the chain holder 140 may be in a state in which the chain holder 140 are fixed to the first chains 100 and the watertight part. Here, the first chains 100 may be substituted by the second chains 200. That is, one of the first chains 100 and the second chains 200 may be coupled to the chain holder 140. In the present embodiment, an example in which the chain holder is coupled to the first chains 100 will be described. The chain holder 140 in the coupled state as described above may be attached to a container. The container may be configured to accommodate a fluid such as air or water. The container may be, for example, a tube that contains air in an airtight manner so that the air does not leak even when a predetermined pressure is applied.

As illustrated in the figures, the first upper chain 110 may be spaced apart from the first lower chain 120. The watertight part may be disposed in the space and fixed to the first guide 130 while being pressed by a predetermined pressure by the first upper chain 110 and the first lower chain 120. By this fixing, water or air cannot pass through the first chains 100 and the second chains 200 that serve to open and close the container. The watertight part may be fixed with one end thereof being inserted into the chain holder 140. This structure also serves to prevent air or water from passing through the first chains 100 and the second chains 200.

In addition, as described above, the chain holder 140 is coupled to one end of each of the first chains 100, the second chains 200, the first guide 130, and the second guide. Thus, when the first chains 100 and the second chains 200 are decoupled and widened to open the container, the chain holder 140 is pulled in the direction in which the first chains 100 and the second chains 200 are widened. A portion of the pulled chain holder 140 may be bent. After being bent, the portion of the pulled chain holder 140 may return to the original position by elastic restoring force. The chain holder 140 may be provided with the elastic restoring portion 142 to facilitate elastic deformation and elastic restoration. The elastic restoring portion 142 has the configuration as illustrated in (b) of FIG. 3.

(b) of FIG. 3 illustrates an example in which the elastic restoring portion 142 and the protrusion 320 are combined together. Specifically, the elastic restoring portion 142 includes the insertion hole 142-1 and the incision portion 142-2. The incision portion 142-2 is provided to facilitate deformation and restoration when the chain holder 140 is elastically deformed by a pulling force that occurs during the coupling and decoupling between the first chains 100 and the second chains 200. In addition, the insertion hole 142-1 is provided not only to facilitate the deformation and restoration but also to allow the protrusion 320 of the watertight part to be inserted into the insertion hole 142-1 in order to prevent fluid, such as air or water, from flowing to the vicinity of the incision portion 142-2.

Specifically, the insertion hole 142-1 may be configured to correspond to the protrusion 320. For example, the insertion hole may be a through-hole having a circular inner diameter, and may be coupled to the protrusion 320 having an outer diameter greater than or equal to the inner diameter of the insertion hole. Here, since the watertight part may be made from a material having elasticity such as silicone or rubber, even when the outer diameter is greater than the inner diameter, the protrusion may be fixedly inserted into the insertion hole when the outer diameter is greater than the inner diameter within an elastically-allowable range.

FIG. 4 is a view illustrating the first upper chain 110 and the second upper chain 210 of the sealing zipper according to an embodiment of the present disclosure.

Referring to FIG. 4, as described above, the first upper chain 110 and the second upper chain 210 may have double-layered tooth profiles facing each other. For example, in the first upper chain 110, the 1-1$^{st}$ coupling teeth 111 and the 1-2$^{nd}$ coupling teeth 112, arranged in the shape of double layers, may be configured to be inversely symmetrical to each other on a plane as illustrated in the figure. The 1-1$^{st}$ coupling teeth 111 and the 1-2$^{nd}$ coupling teeth 112 of the first upper chain 110 extend toward the second upper chain 210. In addition, the 1-1$^{st}$ coupling teeth 111 may have laterally convex features as a coupling structure for being coupled to the 2-1$^{st}$ coupling teeth 211. Of course, the structure is not limited to the "convex features" and refers to any coupling structure employed in a zipper. The convex features are provided for an illustrative purpose only.

When the convex features of the 1-1$^{st}$ coupling teeth 111 are convex to the left, the 1-2$^{nd}$ coupling teeth 112 in a double-layer relationship with the 1-1$^{st}$ coupling teeth 111 may be configured such that the convex features thereof are convex to the right. That is, the coupling structures may be in opposite directions with respect to each other and thus may be configured to be inversely symmetrical to each other. This inversely symmetrical configuration may more firmly maintain coupling force generated for the coupling between the first upper chain 110 and the second upper chain 210.

FIG. 5 is a cross-sectional view illustrating the sealing zipper according to an embodiment of the present disclosure.

Referring to FIG. 5, the sealing zipper may be attached to attachment portions 1 and 2. Here, the attachment portions 1 and 2 may be portions of a sealing container. Precisely, the attachment portions may be peripheral portions of an open area by which the sealing container is opened. In this example, the sealing container is in a sealed state, with the first chains 100 being coupled to the second chains 200. The portions on which the guide grooves 101 and 201 are exposed may be outside the container with respect to the attachment portions 1 and 2, and the opposite portion on which the guide grooves 101 and 201 are not exposed may be inside the container with respect to the attachment portions 1 and 2. Here, covers 5 and 6 may further be provided to prevent the 1-1$^{st}$ coupling teeth 111 and the 2-1$^{st}$ coupling teeth 211 from being directly exposed to the outside in order to prevent contact-induced damage.

The sealed state of the sealing container may be released due to the difference in the pressure between the outside and the inside. For example, as the internal temperature increases or the container is physically pressed, the pressure in the container may increase. As the pressure in the container increases, air or liquid in the container may leak. Accordingly, the watertight part may be disposed between the coupled portions of the first upper chain 110 and the second upper chain 210 and the coupled portions of the first lower chain 120 and the second lower chain 220 in order to prevent inward or outward leakage of a fluid such as air or water.

Furthermore, the fluid must bypass the lateral side of the body 11 of the watertight part in order to leak from the inside to the outside. Thus, the lateral sides of the body 11 may have various shapes to increase the contact area between one lateral side of the body 11 and the first guide 130 and the contact area between the other lateral side of the body 11 and the second guide so that the fluid does not leak even under a higher pressure. In an embodiment, the lateral sides of the body 11 may have a curved shape as illustrated in the figures.

In addition, in the process of opening and closing the sealing zipper, the sealing zipper may be pulled in directions of the attachment portions 1 and 2, respectively. The pulling force generated at this time may be transmitted to the coupling teeth adjacent to the attachment portions 1 and 2. The coupling teeth may be 1-4$^{th}$ coupling teeth 122 and 2-4$^{th}$ coupling teeth 222. Thus, since the 1-4$^{th}$ coupling teeth 122 and the 2-4$^{th}$ coupling teeth 222 need to accommodate the pulling force, the thickness D1 of each of the 1-4$^{th}$ coupling teeth 122 and the 2-4$^{th}$ coupling teeth 222 may be greater than the thickness D2 of each of the 1-3$^{rd}$ coupling teeth 121 and the 2-3$^{rd}$ coupling teeth 221.

FIG. 6 is a perspective view illustrating a rider according to an embodiment of the present disclosure.

Referring to FIG. 6, the rider may include a body portion 310 and sliders 12. The body portion 310 may be coupled to the sealing zipper in a shape surrounding the sealing zipper from the outside of the container. Specifically, the sliders 12 is configured to correspond to the first guide 130 and the second guide of the sealing zipper. The sliders 12 are fitted to the rider so that the rider may be guided to move along the guide grooves 101 and 201. A handle (not shown) may be provided on the body portion 310, such that a user may easily move the rider using the handle. The rider and the sealing zipper may be fitted to each other to form a sealing zipper assembly. In addition, the rider may slide along the guide grooves 101 and 201 in the longitudinal direction of the sealing zipper when the sealing zipper of the sealing zipper assembly is fastened or opened. After moved completely in one direction, the rider may be separated and stored.

FIG. 7 is a view illustrating an example sealing zipper according to another embodiment of the present disclosure.

Referring to FIG. 7, the sealing zipper may include first chains 100 and second chains 200. The sealing zipper may be used as a sealing means in a zipper bag which may store contents, and the top portions of which may be sealed. As an example, the sealing zipper may be provided on the top portion of an accommodation space 700 of the zipper bag in which the contents are accommodated, in the longitudinal direction of an edge of the accommodation space 700, with the first chains 100 facing the second chains 200.

FIG. 8 is a cross-sectional view illustrating a coupled state of the first chains 100 and the second chains 200 of the sealing zipper according to another embodiment of the present disclosure, and FIG. 9 is a cross-sectional view illustrating a decoupled state of the first chains 100 and the second chains 200 illustrated in FIG. 8.

Referring to FIG. 8, a protection member 400 may be disposed between a first attachment portion 1 provided below the first chains 100 and a second attachment portion 2 provided below the second chains 200, wherein the first chains 100 and the second chains 200 may be meshed and coupled. The protection member 400 may be made from a flexible material and may be configured to be biased toward the first chains 100 and the second chains 200 to be into close contact therewith by the pressure of contents stored in the accommodation space 700 applied toward the sealing zipper. Accordingly, the protection member 400 prevents the contents accommodated in the accommodation space from contacting the first chains 100 and the second chains 200, thereby preventing the first chains 100 and the second chains 200 from being contaminated by the contents. Thus, the first chains 100 and the second chains 200 may be maintained in a normal state, so that the coupling force between the first chains 100 and the second chains 200 may be maintained optimally.

A first guide groove 101 and a second guide groove 201 are provided on the first chains 100 and the second chains 200, respectively. In response to the rider 10 sliding along the first guide groove 101 and the second guide groove 201, the first chains 100 and the second chains 200 may be coupled to or decoupled from each other.

The protection member 400 includes a first horizontal portion 410*a* horizontally extending toward the first attachment portion 1, a second horizontal portion 410*b* horizontally extending toward the second attachment portion 2, and a central portion 430 disposed between the first horizontal portion 410*a* and the second horizontal portion 410*b* and define an internal space 420 by sealing a space between the first attachment portion 1 and the second attachment portion 2.

The first horizontal portion 410*a* and the second horizontal portion 410*b* are located below the first attachment portion 1 and the second attachment portion 2, respectively, such that the contents accommodated in the accommodation space 700 may be prevented from moving to the first chains 100 and the second chains 200 through the first attachment portion 1 and the second attachment portion 2.

As the internal space 420 of the central portion 430 is filled with air or a material lighter than water, the central portion 430 may be biased toward the first chains 100 and the second chains 200 to be in close contact therewith by the pressure generated by the contents having higher specific gravity than the internal space.

However, one of the first horizontal portion 410*a* and the second horizontal portion 410*b* may be attached to the first attachment portion 1 or the second attachment portion 2 and the other one of the first horizontal portion 410*a* and the second horizontal portion 410*b* may not be attached to the first attachment portion 1 or the second attachment portion 2, since the introduction of the contents into the accommodation space 700 from the outside should not be disturbed by the protection member 400.

More specifically, as illustrated in FIG. 8, an attachment member 440 may be disposed between and attached to the second horizontal portion 410*b* and the second attachment portion 2, and no attachment member may be provided between the first horizontal portion 410*a* and the first attachment portion 1. However, the present disclosure is not limited thereto. To the contrary, attachment member 440 may be disposed between and attached to the first horizontal portion 410*a* and the first attachment portion 1, and no attachment member may be provided between the second horizontal portion 410*b* and the second attachment portion 2. An important point is that only one of the first horizontal portion 410*a* and the second horizontal portion 410*b* is attached to the corresponding one of the attachment portion 1 and 2.

Referring to FIG. 9, when the first chains 100 and the second chains 200 are decoupled and thus widened from each other, the protection member 400 may also be spaced away so as not to seal the space between the first attachment portion 1 and the second attachment portion 2 so that the contents can be introduced from the outside. Thus, despite the provision of the protection member 400, a user cannot introduce contents into the accommodation space 700 when the first chains 100 are decoupled from the second chains 200.

FIG. 10 is a plan perspective view illustrating a sealing zipper according to an embodiment of the present disclosure. In FIG. 10, the accommodation space 700 connected to the sealing zipper is omitted.

Referring to FIG. 10, a protection member 400 may be disposed below the first and second chain portions 200, and the first attachment portion 1 and the second attachment portion 2 in the sealing zipper. With this configuration, the protection member 400 may reliably prevent the contents in the accommodation space 700 from coming into contact with the first chains 100 or the second chains 200. In addition, the protection member 400 is arranged to extend beyond both ends of the first chains 100 and the second chains 200 in directions in which the first chains 100 and the second chains 200 are opened and closed, thereby reliably blocking between the accommodation space 700 and the first chains 100 and between the accommodation space 700 and the second chains 200. Further, in order to more reliably block between the accommodation space 700 and the first chains 100 and between the accommodation space 700 and the second chains 200, the attachment member 440 may also be located outside both ends of the first chains 100 and the second chains 200 in the directions in which the first chains 100 and the second chains 200 are opened and closed. Thus, the protection member 400 may have the shape of diagonally-mirrored L.

While the exemplary embodiments of the present disclosure have been described in detail hereinabove, a person having ordinary knowledge in the technical field to which the present disclosure pertains will appreciated that various modifications of the foregoing embodiments are possible without departing from the scope of the present disclosure. Therefore, the scope of protection of the present disclosure shall not be limited to the foregoing embodiments but shall be defined by the appended Claims and equivalents thereof.

What is claimed is:

1. A sealing zipper comprising:

a first chain;

a second chain configured to be coupled to the first chain;

a chain holder coupled to one end of the first chain and one end of the second chain; and a watertight part located between the first chain and the second chain, with a portion of the watertight part being inserted into the chain holder, wherein the first chain comprises a first upper chain comprising 1-1$^{st}$ coupling teeth and 1-2$^{nd}$ coupling teeth provided as double layers on one surface side of the watertight part and a first lower chain comprising 1-3$^{rd}$ coupling teeth and 1-4$^{th}$ coupling teeth provided as double layers on the other surface side of the watertight part, and the second chain comprises a second upper chain comprising 2-1$^{st}$ coupling teeth and 2-2$^{nd}$ coupling teeth provided as double layers on one surface side of the watertight part and a second lower chain comprising 2-3$^{rd}$ coupling teeth and 2-4$^{th}$ coupling teeth provided as double layers on the other surface side of the watertight part.

2. The sealing zipper according to claim 1, wherein the sealing zipper is fastened by coupling between the first upper chain and the second upper chain and coupling between the first lower chain and the second lower chain.

3. The sealing zipper according to claim 1, wherein thickness of each of the 1-4$^{th}$ coupling teeth and the 2-4$^{th}$ coupling teeth is greater than a thickness of each of the 1-3$^{rd}$ coupling teeth and the 2-3$^{rd}$ coupling teeth.

4. The sealing zipper according to claim 1, wherein the 1-1$^{st}$ coupling teeth and the 1-2$^{st}$ coupling teeth provided as the double layers are inversely symmetrical to each other;

the 1-3$^{rd}$ coupling teeth and the 1-4$^{th}$ coupling teeth provided as the double layers are inversely symmetrical to each other;

the 2-1$^{st}$ coupling teeth and the 2-2$^{nd}$ coupling teeth provided as the double layers are inversely symmetrical to each other; and the 2-3$^{rd}$ coupling teeth and the 2-4$^{th}$ coupling teeth provided as the double layers are inversely symmetrical to each other.

5. The sealing zipper according to claim 1, wherein the chain holder comprises an elastic restoring portion including an insertion hole and an incision portion and an insertion recess into which one end of the watertight part is inserted;

the watertight part comprises a protrusion protruding from the one end; and the watertight part and the chain holder are coupled to each other, with the protrusion being inserted into the insertion hole.

6. The sealing zipper according to claim 1, wherein each of a first guide and a second guide comprises a guide groove provided in a longitudinal direction; and the first chain and the second chain are coupled to each other in response to a rider moving in a guiding direction of the guide grooves.

7. The sealing zipper according to claim 1, wherein the watertight part comprises a concavely-curved portion.

8. A sealing zipper comprising:

a first chain;

a second chain configured to be coupled to the first chain;

a chain holder coupled to one end of the first chain and one end of the second chain;

a watertight part located between the first chain and the second chain and configured such that a portion thereof is inserted into the chain holder; and a rider configured to couple and decouple the first chain and the second chain while moving in a longitudinal direction along one surface of the first chain and one surface of the second chain, wherein the first chain comprises a first upper chain comprising 1-1st coupling teeth and 1-2nd coupling teeth provided as double layers on one surface side of the watertight part and a first lower chain comprising 1-3rd coupling teeth and 1-4th coupling teeth provided as double layers on the other surface side of the watertight part; and the second chain comprises a second upper chain comprising 2-1st coupling teeth and 2-2nd coupling teeth provided as double layers on one surface side of the watertight part and a second lower chain comprising 2-3rd coupling teeth and 2-4th coupling teeth provided as double layers on the other surface side of the watertight part.

9. A sealing zipper comprising:

a first chain;

a second chain configured to be coupled to the first chain;

a chain holder coupled to one end of the first chain and one end of the second chain;

a watertight part located between the first chain and the second chain and configured such that a portion thereof is inserted into the chain holder; and a first attachment portion connected to a bottom portion of the first chain; and a second attachment portion connected to a bottom portion of the second chain, wherein a protection member is disposed between the first attachment portion and the second attachment portion to protect the first chain and the second chain; and with one portion of the protection member being attached to one of the first attachment portion and the second attachment portion;

wherein the protection member comprises:

a first horizontal portion horizontally extending toward the first attachment portion;

a second horizontal portion horizontally extending toward the second attachment portion; and a central portion located between the first attachment portion and the second attachment portion and comprising a space portion therein.

10. The sealing zipper according to claim 9, wherein the space portion is filled with air or a material lighter than water.

* * * * *